US005151939A

United States Patent [19]

Marrah et al.

[11] Patent Number: 5,151,939

[45] Date of Patent: Sep. 29, 1992

[54] ADAPTIVE AUDIO PROCESSOR FOR AM STEREO SIGNALS

[75] Inventors: Jeffrey J. Marrah; Gregory J. Manlove, both of Kokomo; Richard A. Kennedy, Russiaville; Mark A. Kady, Sharpsville, all of Ind.

[73] Assignee: Delco Electronics Corporation, Kokomo, Ind.

[21] Appl. No.: 496,711

[22] Filed: Mar. 21, 1990

[51] Int. Cl.[5] ..... H04H 5/00

[52] U.S. Cl. ..... 381/15

[58] Field of Search ..... 381/15, 13; 455/266

[56] References Cited

U.S. PATENT DOCUMENTS 4,206,317 6/1980 Kahn ..... 381/15
4,680,795 7/1987 Ecklund ..... 381/15
4,866,779 9/1989 Kennedy et al. ..... 381/15

*Primary Examiner*—Forester W. Isen

*Attorney, Agent, or Firm*—Albert F. Duke

[57] ABSTRACT

An adaptive audio processor for stereo AM broadcast signals includes independent signal processing paths. Each path has a variable lowpass filter and a matrix and variable Q 10 kHz notch filter to form LEFT and RIGHT channel signals with a 10 kHz notched pass band determined by adjacent channel noise. A 10 kHz pass band signal representative of adjacent channel noise from one of the signal processing paths is compared to a reference to generate a correction signal that is fedback to control the lowpass and notch filters. The correction signal adjusts the pass band and Q of the lowpass and notch filters so that the effects of adjacent channel noise are minimized. Other receiver signals which are reflective of the quality of the received broadcast signal, e.g., the AGC signal, an excess modulation signal, and a receiver microprocessor signal are similarly employed to control the lowpass and notch filters.

14 Claims, 9 Drawing Sheets

ADAPTIVE AUDIO PROCESSOR FOR AM STEREO SIGNALS

CROSS REFERENCE

This patent application is related to patent application Nos. G-3350 and G-5802 entitled "Multiple Output Operational Amplifier" and "Switched Capacitor Filters With Continuous Time Control", respectively, which are being filed concurrently with and have a common assignee with this patent application.

FIELD OF THE INVENTION

This invention relates to adaptive processing of audio signals and more particularly to the processing of signals in an AM stereo broadcast receiver to improve performance.

BACKGROUND OF THE INVENTION

AM broadcast stations are assigned operating signals which are spaced at intervals that limit the bandwidth of the transmitted signals. In the United States, AM radio broadcast stations are assigned operating frequencies which are spaced at 10 kHz intervals, and in some countries stations are at 9 kHz intervals. FCC rules now limit AM broadcast stations to a maximum modulating frequency of 15 kHz. Within the constraints imposed by broadcasting standards, relatively high fidelity reception of AM signals is possible in modern broadcast receivers. Such high fidelity reception requires ideal operating conditions including a strong station signal, lack of strong station signals of competing stations with immediately adjacent assigned frequencies, and lack of atmospheric or environmental noise at the receiver site.

The full IF bandwidth is usable in a receiver under the aforementioned ideal conditions. Since the aforementioned conditions for reception are not as a rule present, there usually is noise and annoying whistles in the audio signal. A variety of technical measures have been developed to cope with other than ideal reception conditions. Early AM receivers, for example, included manual controls that permitted selection of the IF bandwidth in two or more steps. More recently, notch filters have been inserted in the audio path to reduce the annoying whistle that sometimes results from the 10 kHz spacing requirement. To further improve reception, provisions have been added to automatically control the Q of notch filters in the audio path of receivers. These measures tend to eliminate adjacent channel carrier whistle and other station noise. It is recognized, however, that manual IF controls are not particularly useful and that merely reducing the Q of a notch filter does not completely eliminate adjacent channel interference.

SUMMARY OF THE INVENTION

The invention is directed to a signal processing system for signals received in a prescribed frequency band which include a first signal and interference from frequencies adjacent the prescribed frequency band. The frequency bandwidth of the received signals is adjusted to produce an output signal representative of the first signal. A band adjustment signal is formed in response to the adjacent frequency interference and the prescribed frequency band is adjusted to reduce the adjacent frequency interference in the output signal.

In accordance with one aspect of the invention, an AM broadcast frequency radio receiver includes a low-pass filter in its audio path. A variable audio processing circuit automatically adjusts the center frequency and Q of the low-pass filter as a function of the strength of adjacent channel signals present in an input audio signal to improve reception. The processing circuit includes a high-gain comparator coupled to the output of the low-pass filter through an adjacent channel indicating bandpass filter. A 10 kHz bandpass filter is employed in U.S. receivers while a 9 kHz band pass filter is employed in some non-U.S. receivers. The comparator generates voltage control signals in response to the output of the bandpass filter to adjust the corner frequency and Q of the low-pass filter so that adjacent channel signals do not exceed a predefined level. In the absence of adjacent channel signals and noise, the low-pass filter provides maximum bandwidth in the audio path. In the presence of increased adjacent channel interference, the bandwidth of the low-pass filter is reduced to reduce the effect of such adjacent channel interference in the audio output signals.

In accordance with another aspect of the invention, the audio processing path includes a notch filter coupled to the output of the lowpass filter to remove adjacent channel noise from the audio output of the receiver. The output of the comparator controls the Q of the notch filter without changing its center operating frequency.

In accordance with yet another aspect of the invention, the receiver is an AM stereo receiver providing L−R and L+R signals and a pair of audio paths which form LEFT and RIGHT channel signals. Each audio path includes a low-pass filter and a notch filter. A single comparator is responsive to adjacent channel interference from the interference bandpass filter in one of the channels to adjust the lowpass filter and the notch filter of both channels.

In accordance with yet another aspect of the invention, the (L−R) channel of a stereo receiver further includes a "blend to mono" variable attenuator in the audio path operative in responsive to very poor received station signals to disable the (L−R) channel.

In accordance with a yet another aspect of this invention, other receiver signals which are reflective of the quality of the received broadcast signal (e.g., the AGC signal) and an excess modulation signal are control the corner frequency of the low-pass filters, the Q of the notch filters, and the attenuation of the variable attenuator.

The invention will be better understood from the following more detailed description taken with the accompanying drawings and claims.

DETAILED DESCRIPTION

Figure 1:
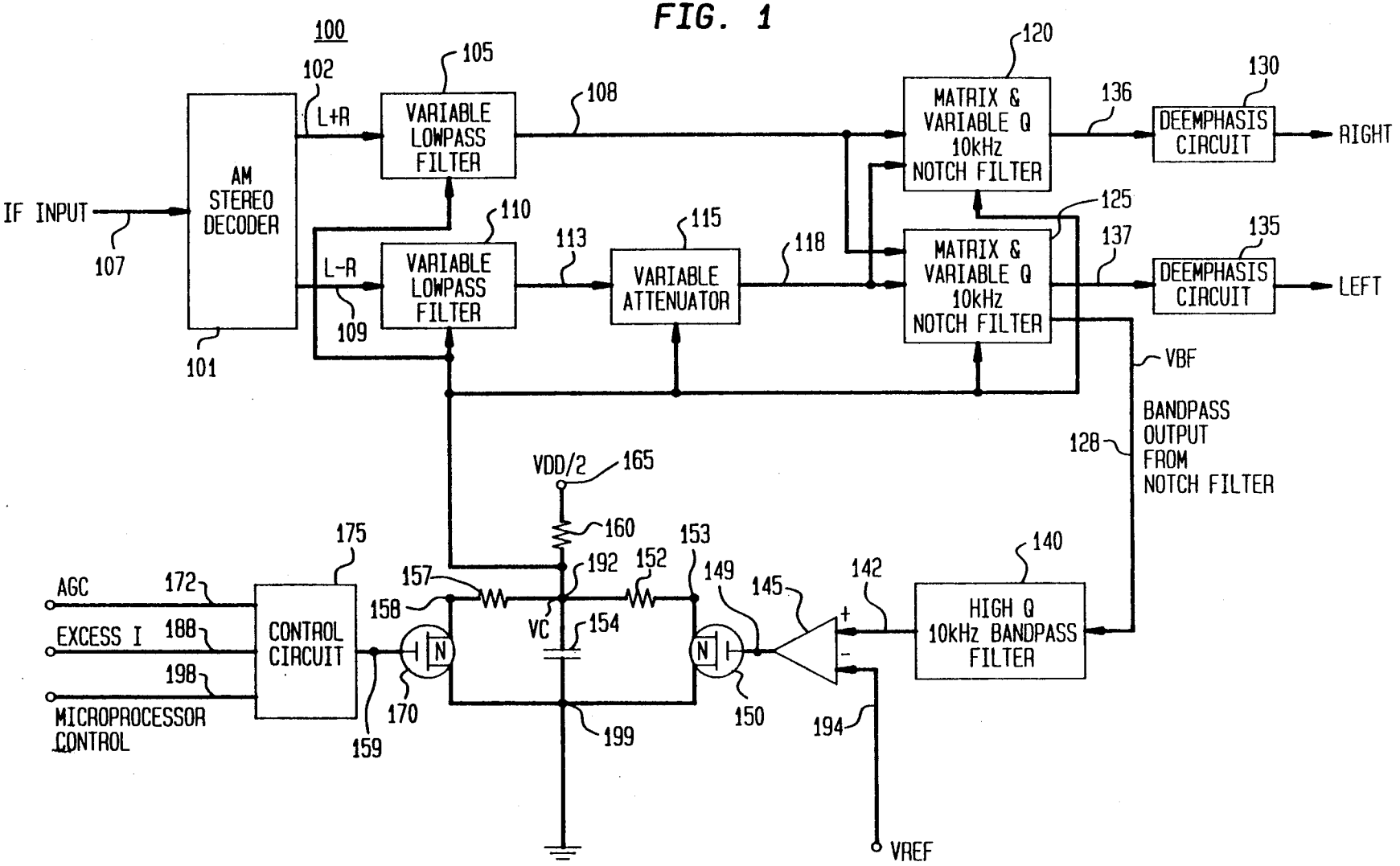
FIG. 1 is a block and schematic diagram of an audio processing circuit in an AM stereo broadcast receiver according to an embodiment of the invention.

Referring to FIG. 1, there is shown an audio processing circuit 100 in accordance with an embodiment of the present invention. The audio processing circuit 100 comprises an AM stereo decoder 101, variable lowpass filters 105 and 110, a variable attenuator 115, matrix and variable Q 10 kHz notch filters 120 and 125, de-emphasis circuits 130 and 135, a resistor 157, an n-channel field effect transistor 170, a control circuit 175 and a voltage source terminal 165, a high Q 10 kHz bandpass filter 140, a comparator 145, an n-channel field effect switching transistor 150, a capacitor 154, and resistors 152 and 160.

In FIG. 1, an input of the AM stereo decoder 101 is coupled to an IF lead 107. A first output (L+R) of the AM stereo decoder 101 is coupled to an input of the variable lowpass filter 105 via a lead 102. A second output (L−R) of AM stereo decoder 101 is coupled to an input of the variable lowpass filter 110 via a lead 109. An output of the variable lowpass filter 105 is coupled via a lead 108 to a first input of the matrix and variable Q 10 kHz notch filter 120 and to a first input of the matrix and variable Q 10 kHz notch filter 125. An output of the variable lowpass filter 110 is coupled to an input of the variable attenuator 115 via a lead 113. An output of the variable attenuator 115 is coupled to a second input of the matrix and variable Q 10 kHz notch filter 120 and to a second input of the matrix and variable Q 10 kHz notch filter 125 via a lead 118. An output of the matrix and variable Q 10 kHz notch filter 120 is coupled to an input of the de-emphasis circuit 130 via a lead 136, and an output of the matrix and variable Q 10 kHz notch filter 125 is coupled to an input of the de-emphasis circuit 135 via a lead 137.

A second output of the matrix and variable Q 10 kHz notch filter 125 is coupled to an input of the high Q 10 kHz bandpass filter 140 via a lead 128 (VBF). An output of the high Q 10 kHz bandpass filter 140 is coupled to a positive input of the comparator 145 via a lead 142. A second input of the comparator 145 is coupled to a reference voltage line 194 which is coupled to a source of a reference signal VREF. An output of the comparator 145 is coupled to the gate of transistor 150 via lead 149. The source electrodes of transistors 150 and 170 and a first terminal of the capacitor 154 are coupled to a ground reference point and to a terminal 199. The drain of transistor 150 is coupled to a first terminal of the resistor 152 and to a terminal 153. A second terminal of the resistor 152 is coupled to a terminal of the resistor 160, to a second terminal of the capacitor 154, to a first terminal of the resistor 157, to a second input of the variable lowpass filter 110, to a second input of the variable lowpass filter 105, to a second input of the variable attenuator 115, to a third input of the matrix and variable Q 10 kHz notch filters 120 and 125, and to a terminal 192. A second terminal of the resistor 160 is connected to the voltage source terminal 165 to which a DC voltage VDD/2 is applied. A second terminal of resistor 157 is coupled to the drain of transistor 170 and to a terminal 158. The gate of transistor 170 is coupled to an output of the control circuit 175 and to a terminal 159. A first input of the control circuit 175 is coupled to an AGC line 172; a second input of the control circuit 175 is coupled to an EXCESS I line 188; and a third input of the control circuit 175 is coupled to a MICROPROCESSOR CONTROL line 198.

The AM stereo decoder 101 receives an IF frequency input signal from the lead 107 and produces a signal (L+R) on the lead 102 and a signal (L−R) on the lead 109 which are coupled to the variable lowpass filter 105 and the variable lowpass filter 110, respectively. The AM stereo decoder 101 may comprise any AM stereo decoder of well known in the art. The AM stereo decoder 101 may be a fully synchronous detector for the I and Q components of the stereo IF signal or may comprise a synchronous detector for the (L−R) signal and an envelope detector for the (L+R) signal.

Each of variable Lowpass filters 105 and 110 has a pass band with its frequency response, i.e., corner frequency and Q, controlled by voltage VC appearing at terminal 192. The variable lowpass filter 105 limits the frequency range of signal (L+R) applied thereto. Similarly, the variable lowpass filter 110 limits the frequency range of signal (L−R) applied thereto. The modified (L+R) signal from the variable lowpass filter 105 and the modified (L−R) signal from serially connected variable lowpass filter 110 and the variable attenuator 115 are applied to inputs of the matrix and 10 kHz variable Q notch filters 120 and 125 via the leads 108 and 118, respectively.

The Q of each matrix and 10 kHz variable Q notch filter 120, 125, as well as the loss of the variable attenuator 115, is determined by the output of the voltage VC on the terminal 192. The output of the matrix and variable Q 10 kHz notch filter 120 is the RIGHT channel component of the stereo signal received by the AM stereo decoder 101. The de-emphasis circuit 130 de-emphasizes the high frequency portion of the RIGHT signal in a manner well known in the art. Similarly, the output of matrix and variable Q 10 kHz notch filter 125 is the LEFT channel component of the stereo signal received by the AM stereo decoder 101 and the de-emphasis circuit 135 operates to de-emphasize the high frequency portion of the LEFT signal.

The (L+R) and (L−R) output signals of the AM stereo decoder 101 retain the pre-emphasis characteristics of a standard AM broadcast frequency signal. In accordance with standard broadcast practice, the high frequency signals of an audio broadcast signal are boosted in level relative to the lower frequency audio signals in accordance with a standard pre-emphasis curve. Emphasis is added as a measure to equalize signal to noise ratios across the band of transmitted audio signals. De-emphasis circuits 130 and 135 are adapted to process the audio signals at the outputs of matrix and 10 kHz variable Q notch filters 120 and 125 in accordance with a standard de-emphasis curve which is the complement of the above referenced emphasis curve.

The matrix and variable Q 10 kHz notch filter bandpass signal VBF which is applied to an input of the high Q 10 kHz bandpass filter 140 via the lead 128. The 10 kHz bandpass signal VBF corresponds to the adjacent channel component of the LEFT channel signal and is proportional to the interference in both channel signals. The lowpass filter 110, the variable attenuator 115, the matrix and variable Q 10 kHz notch filter 125 and the high Q 10 kHz bandpass filter 140, comparator 145, transistor 150, resistors 152 and 160 and capacitor 154 in FIG. 1 form a closed loop that operates to control adjacent channel interference so that the LEFT and RIGHT channel signals are optimum for the existing reception environment.

The adjacent interference containing 10 kHz bandpass signal is processed to form a correction signal at the terminal 192. The correction signal is fedback to the variable lowpass filter 110, the variable attenuator 115 and the matrix and variable Q 10 kHz notch filter 125 to minimize the interference. The correction signal from the terminal 192 modifies the center frequency and Q of variable lowpass filters 105 and 110 and the Q of the matrix and variable Q 10 kHz notch filter 125. The correction signal also controls the loss through attenuator 115 thereby controlling the adjacent channel interference and noise in the LEFT and RIGHT channel signals. In this way, the amplitude and band pass of the 10 kHz signal and therefore the levels of adjacent channel noise in the LEFT and RIGHT channel signal paths at the outputs of variable lowpass filters 105 and 110 are precisely limited.

Figure 8:
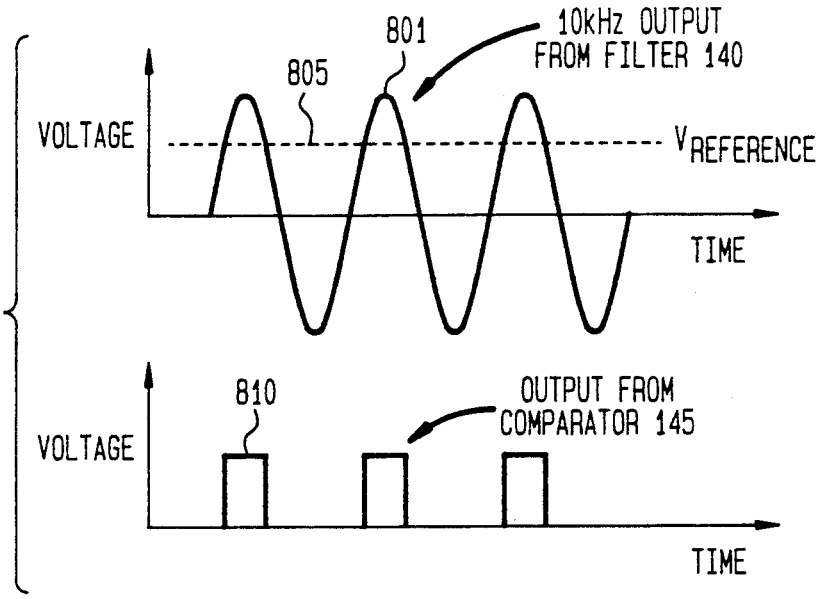
FIGS. 8 and 9 show waveforms illustrating the output signals of the comparator circuit of FIG. 1 under differing conditions of adjacent channel noise.

FIG. 8 graphically shows two voltage vs. time waveforms that illustrate the operation of the comparator 145 when adjacent channel interference is relatively low.

Figure 9:
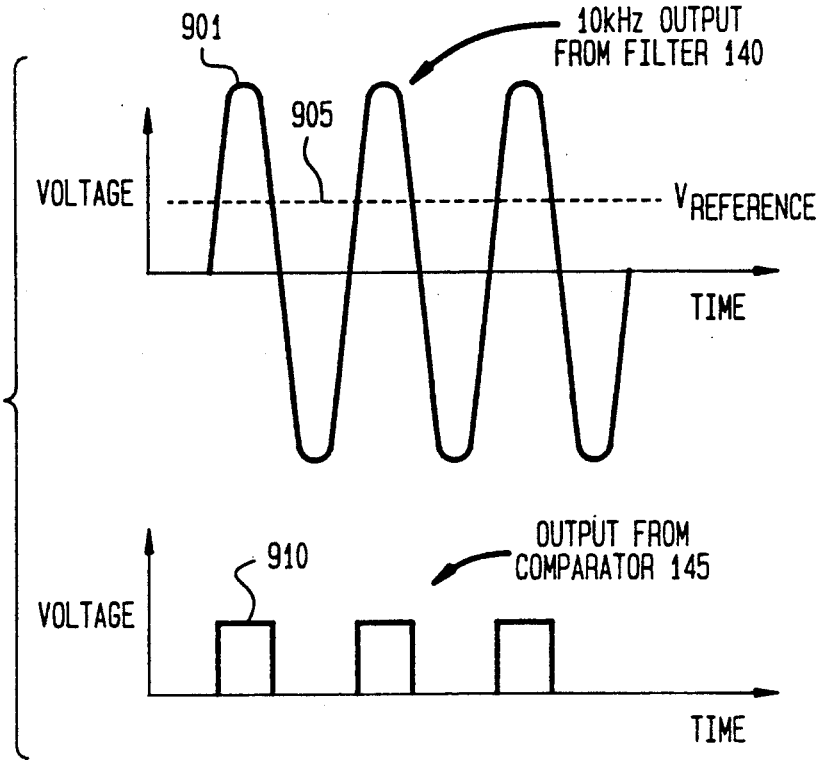

FIG. 9 graphically shows two voltage vs. time waveforms illustrating the operation of the comparator 145 when the adjacent channel interference is relatively high.

Referring to the comparator 145 in FIG. 1 and the waveforms of FIG. 8, the high Q 10 kHz bandpass filter 140 receives the bandpass signal VBF representative of the adjacent channel interference from the matrix and variable Q 10 kHz notch filter 125. The high Q 10 kHz bandpass filter 140 passes the very narrow band 10 kHz portion thereof to a positive (shown as a +) input of comparator 145. The reference voltage VREF is applied to a negative (shown as a −) input of the comparator 145. The voltage waveform 801 in FIG. 8 illustrates the 10 kHz signal on line 142 from the high Q 10 kHz bandpass filter 140 at the positive input of the comparator 145 and the voltage waveform 805 shows as a dashed horizontal line the level of the reference voltage VREF applied to the negative input of comparator 145. As is shown by voltage waveform 810, the output of comparator 145 on terminal 149 is high when the 10 kHz signal from the high Q 10 kHz bandpass filter 140 exceeds reference voltage VREF and is low when the 10 kHz signal from the high Q 10 kHz bandpass filter 140 is below the reference voltage VREF.

Capacitor 154 in FIG. 1 is coupled to a first charging path including DC voltage VDD/2 and resistor 160 and to a discharge path including resistor 152 coupled in series with the source-drain path of the n-channel transistor 150. The resistor 157 and the source-drain path of the n-channel transistor 170 form a second discharge path for capacitor 154. The positive going pulses from output of the comparator 145 shown in waveform 810 are applied to the gate of transistor 150. Capacitor 154 discharges through resistor 152 and the source-drain path of transistor 150 in response to the positive going pulses of waveform 810. Capacitor 154 charges through resistor 160 toward voltage VDD/2 and is discharged through resistor 152 and transistor switch 150. In an illustrative embodiment of circuit 100, VDD/2 is +4 volts DC. In the absence of adjacent channel interference, transistor 150 remains in the non-conducting state and capacitor 154 charges to +4 volts DC. As the adjacent channel interference increases, the duration of the positive output pulses of the comparator 145 increases and transistor 150 is turned on for correspondingly longer periods of time. The voltage on capacitor 154 thereby decreases from the 4 volts DC.

The correction voltage VC at terminal 192 is a function of the relative difference between the 10 kHz signal from the high Q 10 kHz bandpass filter 140 and the reference voltage VREF. Referring to FIG. 9, the 10 kHz signal from the high Q 10 kHz bandpass filter 140 shown in waveform 901 of FIG. 9 is of higher amplitude than the corresponding 10 kHz signal in waveform 801 of FIG. 8. Consequently, the positive going pulses at the output of the comparator 145 shown in waveform 910 are wider than the corresponding positive going pulses in waveform 810 of FIG. 8 and the correction voltage at terminal 192 decreases. As a result, the voltage fedback to the lowpass filter 110, the variable attenuator 115, and the matrix and 10 kHz variable Q notch filter 125 changes in response to the adjacent channel interference in signal VBF from the matrix and variable Q 10 kHz notch filter 125.

The correction voltage produced at terminal 192 is also adjusted in response to other conditions such as the receiver AGC level, excessive input modulation and the state of the receiver microprocessor through the control circuit 175 in the audio processing circuit 100 of FIG. 1. Signals AGC, EXCESS I and MICROPROCESSOR CONTROL applied to inputs of control circuit 175 via the leads 172, 188 and 198, respectively, cause transistor 170 to conduct. Capacitor 154 is then discharged through resistor 157 and the source-drain path of transistor 170, independent of the action of transistor 154.

Figure 2:
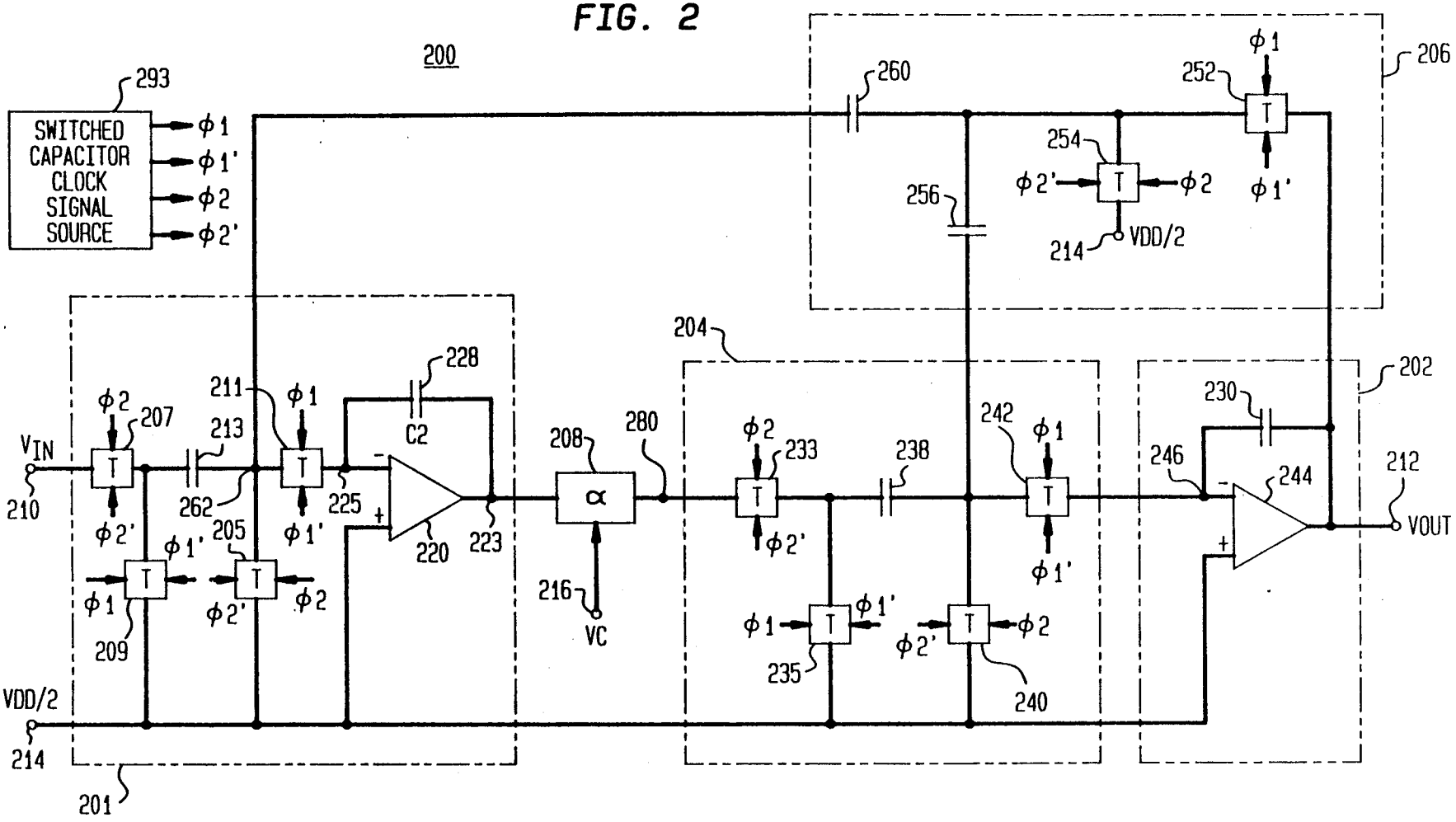
FIG. 2 is a schematic diagram of a low-pass filter employed in audio processing circuit of FIG. 1.

Variable low-pass filters 105 and 110 in the audio processing circuit 100 of FIG. 1 may each comprise a continuously adjustable low-pass filter 200 which is shown in detail in FIG. 2. This type of lowpass filter is shown and described in the above denoted patent application entitled "Switched Capacitor Filters With Continuous Time Control." The pass characteristics of lowpass filters 105 and 110 for eight (8) different control voltage conditions of correction voltage at terminal 192 of FIG. 1 are graphically illustrated in FIG. 5.

Figure 5:
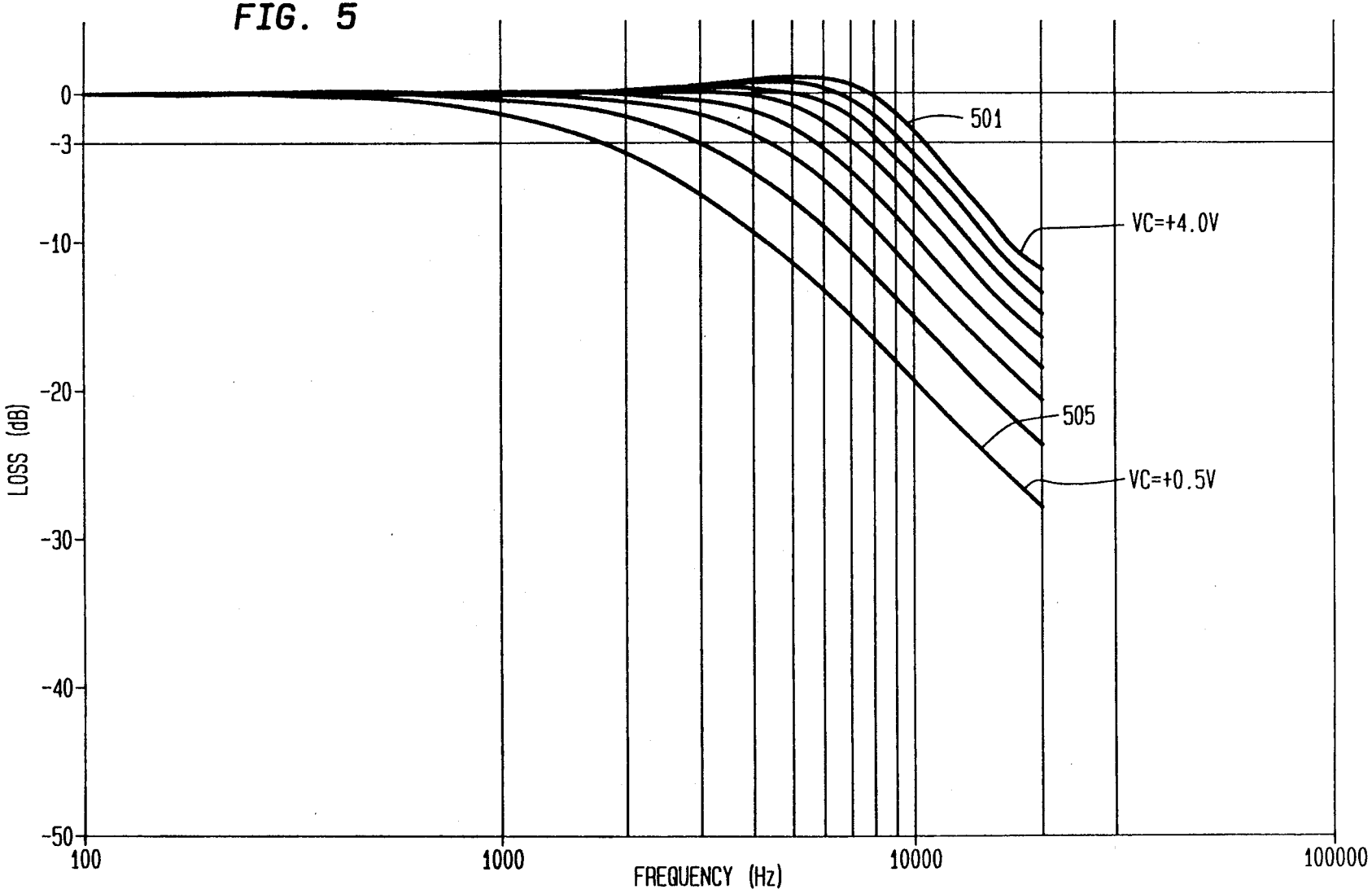
FIG. 5 is a plot that illustrates the pass characteristics of the lowpass filters of FIG. 2 under various conditions of control voltage.

As is readily seen in FIG. 5, a correction voltage of +4.0 volts applied to lowpass filters 105 and 110 on terminal 192 under the best reception conditions results in selection of the widest pass band and the least attenuation. As the correction voltage decreases to 0.5 volts, the pass band is narrowed and the attenuation increases.

Referring now to FIG. 2, there is shown a schematic diagram of a switched capacitor lowpass filter 200 that may be used as the lowpass filter 105 or the lowpass filter 110 in FIG. 1. The filter 200 is essentially the same as a filter of the aforementioned copending patent application entitled "Switched Capacitor Filters with Continuous Time Control". The filter 200 comprises an input terminal 210, a summing circuit 201 (shown within a dashed line rectangle), a variable attenuator 208, a switched capacitor coupling network 204 (shown within a dashed line rectangle), an integrator 202 (shown within a dashed line rectangle) and a switched capacitor feedback circuit 206 (shown within a dashed line rectangle) comprising transmission gates 252 and 254 and capacitors 256 and 260, and a switched capacitor clock signal source 293. The summing circuit 201 comprises transmission gates 205, 207, 209 and 211, a capacitor 213, an operational amplifier 220 and a feedback capacitor 228. The switched capacitor coupling network 204 comprises transmission gates 233, 235, 240 and 242 and a capacitor 238. The integrator 202 comprises an operational amplifier 244 and a feedback capacitor 230.

In FIG. 2, an input signal VIN from the terminal 210 ,which may correspond to the signal (L−R) or (L+R) in FIG. 1, is applied to a negative (−) input terminal 225 of the operational amplifier 220 through the switched capacitor arrangement of $\phi 1$ ($\phi 1'$) clocked transmission gates 209 and 211 and $\phi 2$ ($\phi 2'$) clocked transmission gates 205 and 207 and the capacitor 213. Transmission gates 205 and 209 and a terminal 214 are connected to a voltage source having an output voltage of VDD/2. A positive input (+) of the operational amplifier 220 is connected to the terminal 214. An output of the integrator 202 is also applied to a negative input 225 of the operational amplifier 220 through $\phi 1$ clocked transmission gates 252 and 211 using $\phi 2$ clocked transmission gates 254 and 205.

The signal VIN from the capacitor 213 is combined with a signal fed back from the operational amplifier 244 at a terminal 262 and at the negative input terminal 225 of the operational amplifier 220. The output of the operational amplifier 220 is supplied to the switched capacitor coupling network 204 through the variable attenuator 208. A signal VC applied to a terminal 216 controls the amplitude of the signal at the output of the variable attenuator 208 appearing on a terminal 280 which in turn determines the effective resistance of the switched capacitor coupling network 204. In this way, the effective resistance in the switched capacitor coupling network 204 can be continuously adjusted responsive to the control voltage VC. In the filter 200 of FIG. 2, the capacitor 238 is charged through $\phi 2$ clocked transmission gates 233 and 240 and is discharged into the negative input of amplifier 244 at terminal 246 through $\phi 1$ clocked transmission gates 235 and 242. The voltage at a terminal 280 between the variable attenuator 208 and the transmission gate 233 is a replica of the signal from the operational amplifier 220 at a terminal 223. The signal replica magnitude is a function of the control voltage VC at terminal 216. Thus, the charge packets on the capacitor 238 and consequently the effective resistance of the switched capacitor coupling circuit 204 varies in accordance with the control voltage VC. The effective resistance of the switched capacitor coupler network 204 controls the center operating frequency and the Q of the filter.

The filter circuit 200 is a continuously adjustable low-pass filter. The low-pass characteristics of the switched capacitor lowpass filter 200 for eight (8) different control voltage conditions at the VC terminal 216 of FIG. 2 are illustrated in FIG. 5.

Referring now to FIG. 5, there is graphically shown the low-pass characteristics of the filter 200 with loss in db on the y-axis and frequency in Hz on the x-axis. A maximum voltage condition (e.g., +4 volts of VC at terminal 216 in the switched capacitor lowpass filter 200) results in a maximum bandwidth curve (waveform 501) for the variable low-pass filter 200. A minimum voltage condition, 0.5 volt or less, at terminal 216 results in the minimum bandwidth curve (waveform 505) for the filter 200. As seen in FIG. 5, the output the low-pass filter 200 of FIG. 2 is down approximately 3 db at 10,000 Hz in the maximum bandwidth condition (waveform 501) and the output is down approximately 3 db at 1,800 Hz in the minimum bandwidth condition shown on waveform 505.

Referring again to FIG. 2, the output (terminal 246) of the switched capacitor coupling network 204 is applied to the input of the integrator circuit 202 which further determines the transfer function of the filter 200. A signal VOUT from the output of the integrator 202 at a terminal 212 is fed back to the input and summing circuit 201 to further determine the transfer characteristic of the switched capacitor lowpass filter 200 and to stabilize its operation. Negative feedback from the output of the operational amplifier 244 to the inverting (negative) input thereof at the terminal 246 is provided by the switched capacitor arrangement of transmission gates 252, 254, 240 and 242 and the capacitor 256 and the feedback capacitor 230.

Negative feedback from the output of the operational amplifier 244 to the inverting input 225 of the operational amplifier 220 is provided by the transmission gates 252, 254, 205 and 211 and the capacitor 260. A variable attenuator such as the type employed as the variable attenuator 208 may be used in place of the operational amplifier 244 whereby the effective resistance of the switched capacitor feedback network 206 may be varied to adjust the parameters of the feedback network in accordance with a control voltage similar to voltage VC. In FIG. 2, switched capacitor clock signals $\phi 1$ and $\phi 2$ may, for example, be non-overlapping square wave signals which occur at a 45 kHz repetition rate and the transmission gates shown in FIG. 2 may be bidirectional transmission gates well known in the art. The voltage VDD/2 could be, for example, +4 volts. The output signal at terminal 212 is then the an audio signal VIN modified by the transfer function of filter 200 in FIG. 2 and centered about VDD/2.

The variable attenuator 208 in lowpass filter 200 of FIG. 2 can be any continuously adjustable voltage controlled attenuator. In the preferred embodiment of our invention, however, operational amplifier 220 and attenuator 208 together comprise a dual output amplifier as shown in FIG. 10 which is the subject of the previously denoted copending patent application entitled "Multiple Output Operational Amplifier."

Figure 10:
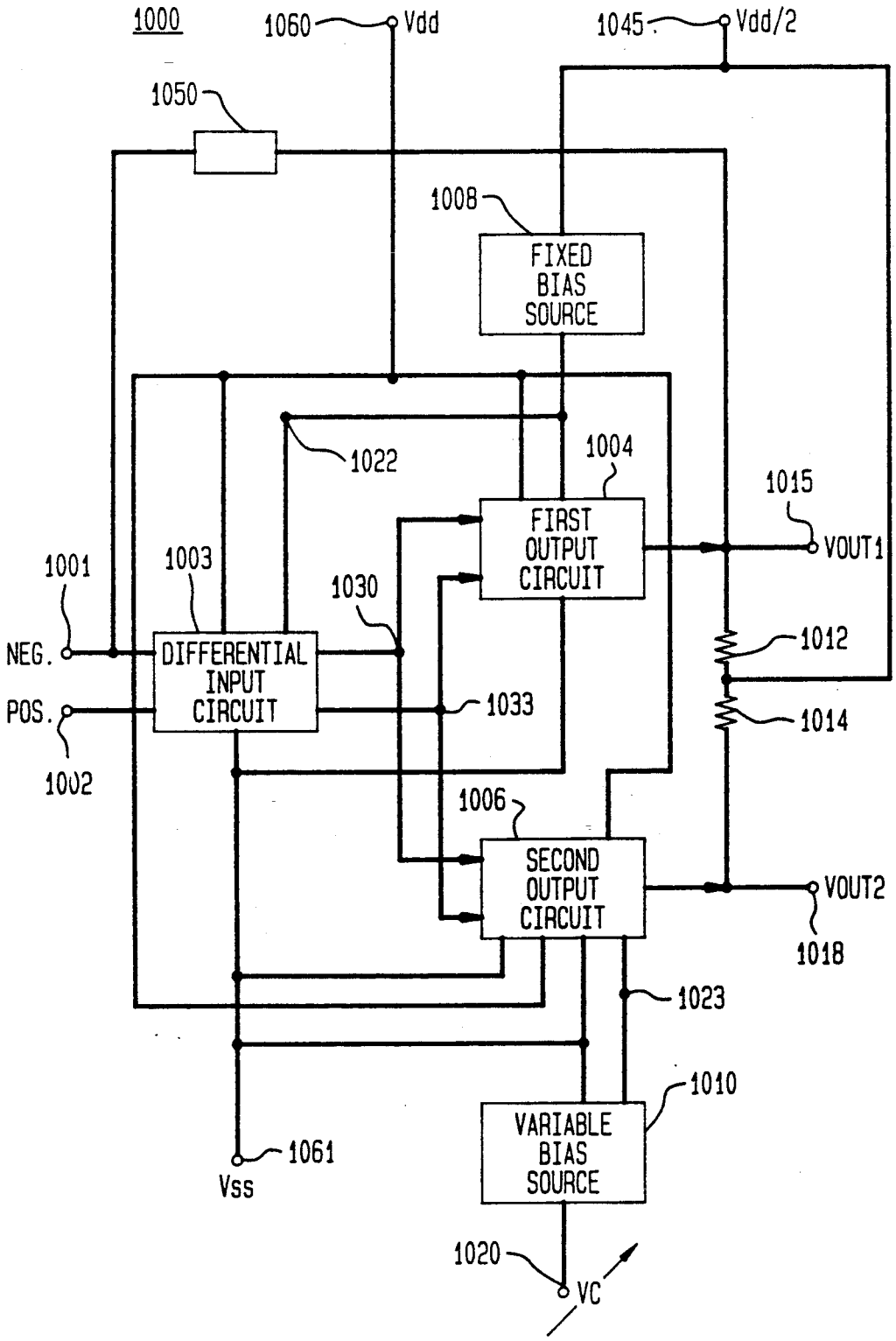
FIG. 10 is a block diagram of a dual output amplifier employed in the audio processing circuit of FIG. 1.

Referring to FIG. 10, there is shown a multiple output amplifier 1000 that may be used as the amplifier 220 and the variable attenuator 208 in the low-pass filter 200 shown in FIG. 2. Amplifier 1000 comprises a differential input circuit 1003, a first output circuit 1004, a second output circuit 1006, a fixed bias source 1008, a variable bias source 1010, first and second load impedances 1012 and 1014, and a feedback element 1050. A first input terminal 1001 of amplifier 1000 is coupled to a first input of differential input circuit 1003 and is shown coupled to an input signal NEG. A second input terminal 1002 of amplifier 1000 is coupled to a second input of differential input circuit 1003 and is shown coupled to an input signal POS. Amplifier 1000 generates a first output signal VOUT1 at a first output terminal 1016 of amplifier 1000 which is coupled to an output of the first output circuit 1004, to a first terminal of load impedance 1012, and to a first terminal of the feedback element 1050. The amplifier 1000 generates a second output signal VOUT2 at a second output terminal 1018 of amplifier 1000 which is coupled to an output of the second output circuit 1006 and to a first terminal of the load impedance 1014. First power supply terminals of the differential input circuit 1003 and the first and second output circuits 1004 and 1006 are coupled to a power supply Vdd and to a terminal 1060. Second terminals of load impedances 1012 and 1014 are coupled to a first power supply terminal of the fixed bias source 1008, to a power supply Vdd/2 and to a terminal 1045. An input of the variable bias source 1010 is coupled to a variable control voltage source VC (shown as VC with an arrow therethrough) and to a terminal 1020.

A first output terminal of the differential input circuit 1003 is coupled to first inputs of the first and second output circuits 1004 and 1006 and to a terminal 1030. A second output terminal of differential input circuit 1003 is coupled to second inputs of first and second output circuits 1004 and 1006 and to a terminal 1033. An output of fixed bias source 1008 is coupled to power supply inputs of the first output circuit 1004 and the differential input circuit 1003 and to a terminal 1022. An output of the variable bias source 1010 is coupled to a power supply input of the second output circuit 1006 and to a terminal 1023. A second terminal of the feed back element 1050 is coupled to the input terminal 1001.

Differential input circuit 1003 receives input signals NEG. and POS. from terminals 1001 and 1002, respectively, and forms an amplified signal corresponding to the difference between signals NEG and POS. The amplified differential signal appears across output terminals 1030 and 1033. The amplified signal from terminals 1030 and 1033 is applied to the first output circuit 1004 and to the second output circuit 1006. The signal VOUT1 is generated in the first output circuit 1004 and appears across the load impedance 1012 between lead 1016 and terminal 1045. The terminal 1045 is effective as an A.C. ground. A separate output signal VOUT2 is obtained from the second output circuit 1006 and appears across the load impedance 1014 between the terminal 1018 and the terminal 1045.

Each of output circuits 1004 and 1006 operates independently in response to the bias voltages applied thereto from bias sources 1008 and 1010, respectively. Signals VOUT1 and VOUT2 are amplified versions of the signal corresponding to the difference between signals NEG. and POS. The magnitude of the signal VOUT1 from the output circuit 1004, which is controlled by the fixed bias source 1008, is independent of the magnitude of the signal VOUT2 from the output circuit 1006, which is controlled by the variable bias source 1010. The output of the fixed bias source 1008 supplies a bias control voltage to the differential input circuit 1003 and to the first output circuit 1004. The gain of the output circuit 1004 is maintained at a prescribed level determined by the fixed bias source 1008. The variable (adjustable) bias source 1010, which controls the gain of the second output circuit 1006, receives a control voltage from the power supply VC. The control voltage VC may be continuously adjusted so that the gain of the second output circuit 1006 is adjustable. It is to be understood that additional output circuits substantially identical to second output circuit 1006 may be added to provide a plurality of output signals each controllable from a separate adjustable power supply like VC.

As is well known in the art, the gain of an operational amplifier is generally stabilized by providing a feedback path between its output and its input. Such a feedback path, however, interferes with any attempted adjustment of the gain by a bias source. As aforementioned, there are circuit applications in which a bias controlled variable signal from an operational amplifier is required as in a switched capacitor arrangement. In accordance with the invention, a bias controlled variable signal voltage is produced by an operational amplifier. The gain stability of the operational amplifier is assured by providing a feedback path between a fixed biased output stage and the input stage, while the gain of a variable biased output stage provides the needed bias controlled variable voltage. In the amplifier circuit 1000 of FIG. 10, the feedback element 1050 is shown coupled between the terminal 1016 at the output of the fixed biased first output circuit 1004 and the input terminal 1001 so that the operation of amplifier 1000 is stabilized. Other operational amplifier feedback arrangements well known in the art may also be employed. The second output circuit 1006 is controlled by the voltage VC through the adjustable bias source 1010 whereby its gain is continuously adjustable. In this way, a bias controlled variable voltage is produced by a gain stabilized operational amplifier. It is apparent that more variable bias controlled output circuits similar to the second output circuit 1006 may be added to amplifier 1000 as long as one fixed bias controlled circuit such as the output circuit 1004 is used. The addition of a feedback path between the output of the first output circuit 1004 and the differential input circuit 1003 further assures gain stability.

Figure 11:
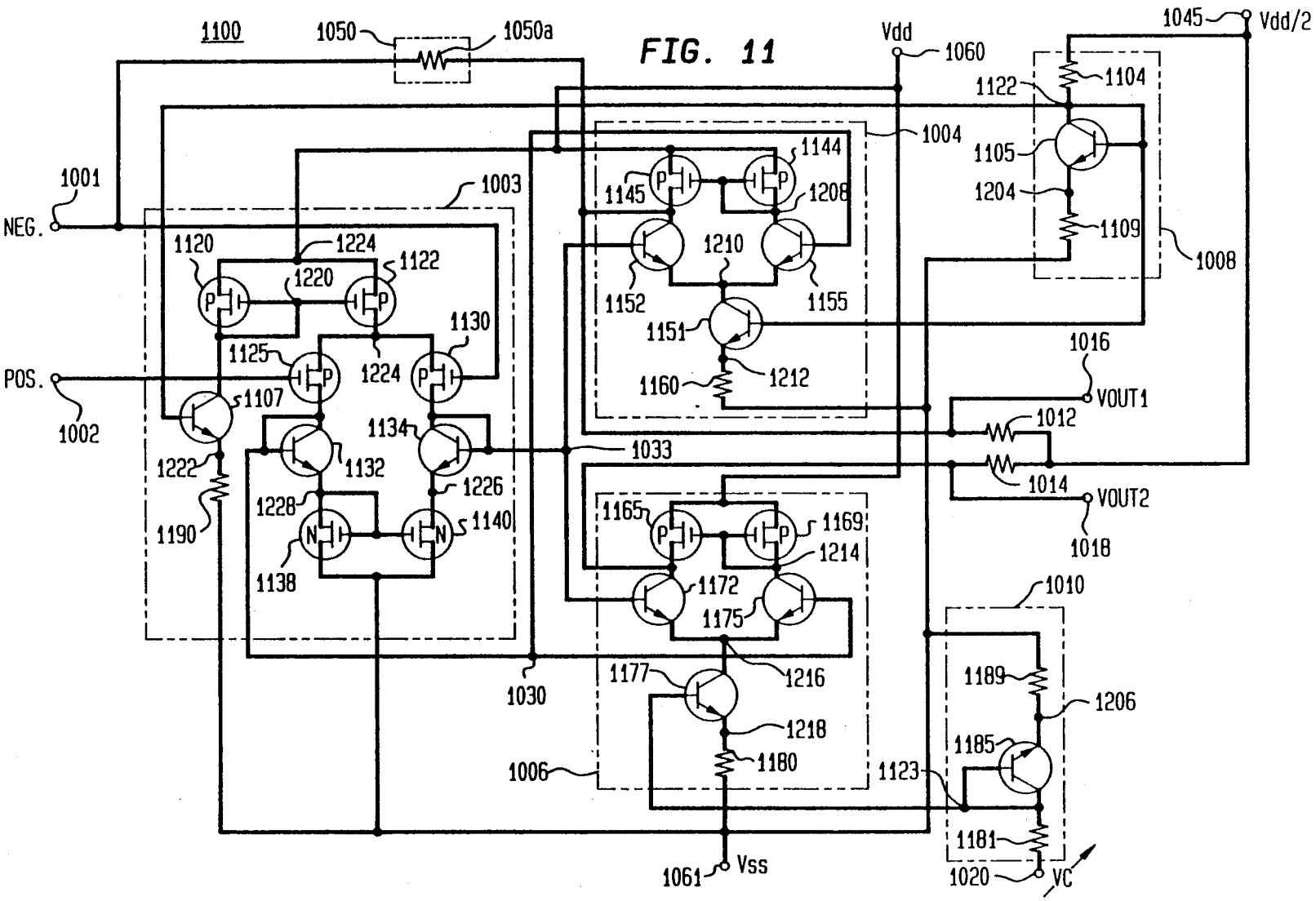
FIG. 11 is a schematic diagram of an illustrative embodiment of the dual output operational amplifier of FIG. 10.

Referring now to FIG. 11, there is shown a schematic diagram of an amplifier circuit 1100 that may be used as amplifier 1000 of FIG. 10. Each of the blocks of FIG. 10 is shown as a corresponding dashed line rectangle in FIG. 11 with the same reference number used in FIGS. 10 and 11. Each of the circuits of FIG. 11 comprises transistors and resistors coupled together to perform the needed function.

The fixed bias source 1008 comprises resistors 1104 and 1109 and an n-p-n bipolar transistor 1105. The variable bias source 1010 comprises resistors 1181 and 1189 and an n-p-n bipolar transistor 1185. The differential input amplifier 1003 comprises p-channel field effect transistors 1120, 1122, 1125 and 1130, n-channel field effect transistors 1138 and 1140, n-p-n bipolar transistors 1107, 1132 and 1134, and a resistor 1190. The first output circuit 1004 comprises p-channel field effect transistors 1144 and 1145, n-p-n bipolar transistors 1151, 1152 and 1155 and a resistor 1160. The second output circuit 1006 comprises p-channel field effect transistors 1165 and 1169, n-p-n bipolar transistors 1172, 1175 and 1177, and a resistor 1180. In an illustrative embodiment, all of the field effect transistors (FET) are typically metal-oxide-semiconductor (MOS) transistors which may be denoted as MOSFETs. In a preferred embodiment the "metal", which is typically used for the gate, is polysilicon. Load impedances 1012 and 1014 are shown as resistors 1012 and 1014, respectively, and the feedback element 1050 is shown as a resistor 1050*a*.

A first terminal of resistor 1104 and first terminals of resistors 1012 and 1014 are coupled to a power supply having a positive output voltage of Vdd/2 and to the terminal 1045. The sources of transistors 1120, 1122, 1144, 1145, 1165 and 1169 are coupled to a power supply having a positive output voltage of Vdd and to the terminal 1060. First terminals of resistors 1109, 1160, 1180, 1189 and 1190, and the sources of transistors 1138 and 1140 are coupled to a reference power supply having a voltage of Vss (typically ground) and to the terminal 1061. The input terminal 1001 is coupled to the gate of transistor 1130 and to a first terminal of the feedback resistor 1050*a*. The input terminal 1002 is coupled to the gate of transistor 1125. The output terminal 1016 is coupled to a second terminal of the resistor 1012, to the collector of transistor 1152, to the drain of transistor 1145 and to a second terminal of the feedback resistor 1050*a*. The output terminal 1018 is coupled to a second terminal of resistor 1014, to the collector of transistor 1172 and to the drain of transistor 1165.

A second terminal of resistor 1104 is coupled to the collector and base of transistor 1105, to the bases of transistors 1107 and 1151 and to the terminal 1122. The emitter of transistor 1105 is coupled to a second terminal of the resistor 1109 and to a terminal 1204. A first terminal of resistor 1181 is coupled to a terminal 1020 and to a voltage source having a variable output voltage VC which is shown as VC with an arrow therethrough. A second terminal of resistor 1181 is coupled to the base and collector of transistor 1185, to the base of transistor 1177 and to the terminal 1123. The emitter of transistor 1185 is coupled to a second terminal of the resistor 1189 and to a terminal 1206.

The gates of transistors 1144 and 1145 are coupled to the drain of transistor 1144, to the collector of transistor 1155 and to a terminal 1208. The emitters of transistors 1152 and 1155 are coupled to the collector of transistor 1151 and to a terminal 1210. The emitter of transistor 1151 is coupled to a second terminal of resistor 1160 and to a terminal 1212. The bases of transistors 1132, 1155 and 1175 are coupled to the collector of transistor 1132, to the drain of transistor 1125 and to the terminal 1030. The bases of transistors 1134, 1152 and 1172 are coupled to the collector of transistor 1134, to the drain of transistor 1130 and to the terminal 1033.

The gate of transistor 1165 is coupled to the gate and drain of transistor 1169, to the collector of transistor 1175 and to a terminal 1214. The emitters of transistors 1172 and 1175 are coupled to the collector of transistor 1177 and to a terminal 1216. The emitter of transistor 1177 is coupled to a second terminal of resistor 1180 and to a terminal 1218.

The drain and gate of transistor 1120 are coupled to the collector of transistor 1107, to the gate of transistor 1122 and to a terminal 1220. The emitter of transistor 1107 is coupled to a second terminal of the resistor 1190 and to a terminal 1222. The drain of transistor 1122 is coupled to the sources of transistors 1125 and 1130 and to a terminal 1224. The emitter of transistor 1134 is coupled to the drain of transistor 1140 and to a terminal 1226. The emitter of transistor 1132 is coupled to the gate and drain of transistor 1138, to the gate of transistor 1140 and to a terminal 1228.

The fixed bias source 1008 of the amplifier 1100 of FIG. 11 comprises a voltage divider arrangement connected between Vdd/2 (terminal 1045) and Vss (DC ground, terminal 1061). A preset voltage Vdd/2 applied to the terminal 1045 causes a predetermined current to flow through the resistor 1104, the diode connected transistor 1105 and the resistor 1109. A preset voltage proportional to voltage Vdd/2 appears at the commonly connected base and collector (terminal 1122) of transistor 1105. This preset voltage is supplied to the bias arrangement (i.e., the base of transistor 1107) for source coupled transistors 1125 and 1130 of the differential input circuit 1003 of the amplifier 1100 of FIG. 11 and to the emitter bias arrangement for emitter coupled transistors 1152 and 1155 of the first output circuit 1004 of the amplifier 1100 of FIG. 11. As a result of the preset voltage Vdd/2 at terminal 1045, the gains of the differential input circuit 1003 and first output circuit 1004 portions of the amplifier in FIG. 11 are fixed.

The variable bias source 1010 of the amplifier 1100 of FIG. 11 comprises a voltage divider arrangement connected between the control voltage terminal 1020 and Vss (typically DC ground). An adjustable control voltage VC applied to terminal 1020 controls the current flow through the resistor 1181, the diode connected transistor 1185 and the resistor 1189. A voltage proportional to the adjustable control voltage VC appears at the commonly connected base and collector (terminal 1123) of transistor 1185. This adjustable voltage is supplied to the bias arrangement of the output circuit 1006 of the amplifier of FIG. 11 including emitter connected transistors 1172 and 1175. As a result of the adjustable voltage VC, the gain of the second output circuit portion of the amplifier in FIG. 11 may be continuously adjusted in response to the control voltage VC.

In the differential input circuit portion of the amplifier of FIG. 11, input signals POS and NEG are applied to the gates of transistors 1125 and 1130, respectively. Transistors 1125 and 1130 operate as a source connected pair to amplify the difference between signals NEG and POS. The current for the sources of transistors 1125 and 1130 is coupled from the base of transistor 1105 of the fixed bias source 1008 to source connected transistors 1125 and 1130 through the source bias transistor 1107 and the current mirror connected transistors 1120 and 1122. The voltage at the base of transistor 1107 is controlled by the voltage at the collector and the base of transistor 1105. Since the collector base path of transistor 1107 is connected in series with the source-drain path of transistor 1120, the drain current through transistor 1120 and the drain current from transistor 1122 into terminal 1224 is fixed by the voltage VDD/2 at terminal 1045. Consequently, the current supplied to the commonly connected sources of transistors 1125 and 1130 from terminal 1224 is predetermined.

Diode connected transistors 1132 and 1134 and current mirror connected transistors 1138 and 1140 form an active load for the drains of transistors 1125 and 1130. The drain of transistor 1125 is connected to the drain and gate of transistor 1138 through the collector-emitter path of diode connected transistor 1132 while the drain of transistor 1130 is connected to the drain of transistor 1140 through the collector-emitter path of diode connected transistor 1134. The differential signal output of the input circuit 1003 of the amplifier 1100 shown in FIG. 11 appears between the drains of transistors 1125 and 1130. The gain of the amplifier input circuit 1003 in FIG. 11 is determined by the source bias current which is in turn controlled by the base voltage of n-p-n source bias transistor 1107. Since this base voltage is fixed, the gain of the input circuit 1003 of FIG. 11 is preset at a constant value.

In the first output circuit 1004 of the amplifier 1100 shown in FIG. 11, the base of n-p-n transistor 1152 is connected to the drain of transistor 1130 and the base of transistor 1155 is connected to the drain of transistor 1125. These bases receive the differential output signal from input circuit transistors 1125 and 1130. The emitters of n-p-n transistors 1152 and 1155 are connected together at terminal 1210 and to a bias arrangement comprising the transistor 1151 and the resistor 1160 connected between terminal 1210 and Vss. The base of transistor 1151 is connected to the base of transistor 1105 in the fixed bias circuit 1008 of FIG. 11. Consequently, the current through the collector-emitter path of transistor 1151 is controlled by the fixed voltage VDD/2 at the terminal 1045. The gain of the first output circuit 1004 is thereby fixed with respect to the circuit bias as is the gain of input circuit 1003.

The load circuit for n-p-n transistors 1152 and 1155 includes current mirror connected transistors 1144 and 1145 whose sources receive fixed DC voltage Vdd from the terminal 1060 and the load resistor 1012 connected between the terminal 1045 and the collector of n-p-n transistor 1152. Transistor 1152 also has its collector connected to the drain of transistor 1145 as well as to resistor 1012. Transistor 1155 has its collector connected to the gates of transistors 1144 and 1145 and to the drain of transistor 1144 via terminal 1208. Diode connected n-p-n transistors 1132 and 1134 of input circuit 1003, which are connected to the bases of transistors 1152 and 1155, help prevent saturation of the transistors 1151 and 1177.

In operation, transistors 1152 and 1155 of the first output circuit 1004 in FIG. 11 convert the differential voltage applied to their respective bases to an output current which flows through load resistor 1012 and produces a single ended output voltage VOUT1 at terminal 1016. In the event the voltages at the bases of transistors 1152 and 1155 are balanced (i.e., the same) the drain current through the load transistor 1145 is the same as the collector current of n-p-n transistor 1152. As a result, no current flows through resistor 1012 and the voltage VOUT1 at terminal 1016 is the same as the voltage at terminal 1045, i.e., VDD/2. A differential voltage appearing between the bases of n-p-n transistors 1152 and 1155 causes a net current flow through the resistor 1012. A non-zero output voltage VOUT1 then appears at terminal 1016 relative to the AC ground at terminal 1045. As is well known in the art, the feedback element 1050 sets the gain and assures gain stability of the operational amplifier of FIG. 11. In other applications, however, the feedback element is not used or stability may be assured by external feedback elements.

In the second output circuit 1006 of the amplifier shown in FIG. 11, the base of transistor 1172 is connected to the drain of transistor 1130 and the base of transistor 1175 is connected to the drain of transistor 1125. In this way, the differential output signal from the input circuit transistors 1125 and 1130 is applied to the second output circuit 1006. The emitters of n-p-n transistors 1172 and 1175 are connected together and to a bias arrangement provided at the terminal 1216. The bias arrangement comprises the series connected collector emitter path of n-p-n transistor 1177 and resistor 1180 connected between terminal 1216 and Vss (DC ground). The base of n-p-n transistor 1177 is connected to the base of transistor 1185 in the variable bias circuit 1010 of FIG. 11. Consequently, the current through the collector-emitter path of n-p-n transistor 1177 is controlled by adjustable voltage VC at terminal 1020. The gain of the second output circuit is thereby rendered adjustable responsive to control voltage VC.

The load circuit for transistors 1172 and 1175 includes current mirror connected transistors 1165 and 1169 whose sources receive fixed DC voltage Vdd and load resistor 1014 connected between voltage Vdd/2 carrying terminal 1045 and the collector of transistor 1172. Transistor 1172 has its collector connected to the drain of transistor 1165 as well as to resistor 1014 while the transistor 1175 has its collector connected to the drain and gate of transistor 1169 and to the gate of transistor 1165.

The operation of the second output circuit 1006 of the amplifier in FIG. 11 is similar to that described with respect to the first output circuit 1004. Transistors 1172 and 1175 of the second output circuit portion in FIG. 11 convert the differential voltage applied between their respective bases to an output current which flows through the load resistor 1014 and provides an output signal VOUT2 at the terminal 1018. In the event the voltages at the bases of transistors 1172 and 1175 are balanced, the drain current of the load transistor 1165 is equal to the collector current of transistor 1172. Consequently, no current flows through the resistor 1014 and the voltage VOUT2 at the terminal 1018 is equal to the voltage at the terminal 1045 i.e. VDD/2. A differential voltage appearing between the bases of transistors 1172 and 1175 causes a net output current to flow through the resistor 1014. A non-zero output voltage VOUT2 then appears at the terminal 1018.

The adjustable (variable) voltage VC in the circuit of FIG. 11 is received by the adjustable bias source 1010 and may be continuously adjustable in response to an external operating parameter. The adjustable voltage VC causes the voltage applied to the base of transistor 1177 in the second output circuit 1006 to vary so that the gain of the second output circuit 1006 changes in accordance with the value of control voltage VC. The emitter bias current provided by transistor 1177 is varied from a minimum of zero to a maximum equal to the collector current in bias transistor 1151 of the amplifier first output circuit 1004 in FIG. 11. As a result, the gain of the second output circuit 1006 in which emitter coupled transistors 1172 and 1175 are controlled by n-p-n bias transistor 1177 is adjustable between zero and the preset gain of the first output circuit 1004 controlled by bias transistor 1151.

In an illustrative embodiment Vdd=+8 volts, Vdd/2=+4 volts, Vss=zero volts and resistors 1012, 1014, 1050, 1104, 1109, 1160, 1180, 1181, 1189 and 1190 are 50K, 50K, 100K, 36K, 1.8K, 450, 450, 1.8K, 36K, and 1.8K ohms, respectively.

The voltage VC in the circuit of FIG. 11 is received by the variable bias source 1010 from terminal 192 in FIG. 1 and may be continuously adjustable in response to the correction voltage therefrom. The adjustable voltage VC causes the voltage applied to the base electrode of n-p-n bias transistor 1177 to vary so that the gain of the second output circuit 1006 changes in accordance with the value of the correction voltage VC. The emitter bias current provided by n-p-n transistor 1177 is varied from a minimum of zero to a maximum equal to the collector current in bias transistor 1151 of the amplifier first output circuit 1004 in FIG. 11. As a result, the gain of the second output circuit 1006 comprising emitter connected n-p-n transistors 1172 and 1175 may vary between zero and the preset gain of the first output circuit controlled by bias transistor 1151.

In the switched capacitor lowpass filter 200 of FIG. 2, differential input circuit 1003 of FIG. 10 functions as operational amplifier 220 and second output circuit 1006 functions as variable attenuator 208. Input voltage NEG. in FIG. 10 is used as terminal 210 in the switched capacitor lowpass filter 200. The terminal 1018 of FIG.

10 is connected to terminal 280 in FIG. 2 and voltage VOUT2 at terminal 1018 is the signal applied to transmission gate 233 of switched capacitor coupling network 204 in FIG. 2.

The variable attenuator 115 shown in the audio processing circuit 100 of FIG. 1 may also comprise the amplifiers of FIGS. 10 and 11. Correction voltage VC is applied to the variable attenuator 115 to determine the loss therethrough. As the correction voltage VC at terminal 192 becomes lower corresponding to increasingly poor reception conditions, the loss through variable attenuator 115 increases so that the (L−R) signal is gradually removed. The RIGHT and LEFT outputs of de-emphasis circuits 130 and 135 then blend to a more acceptable monophonic signal.

Figure 3:
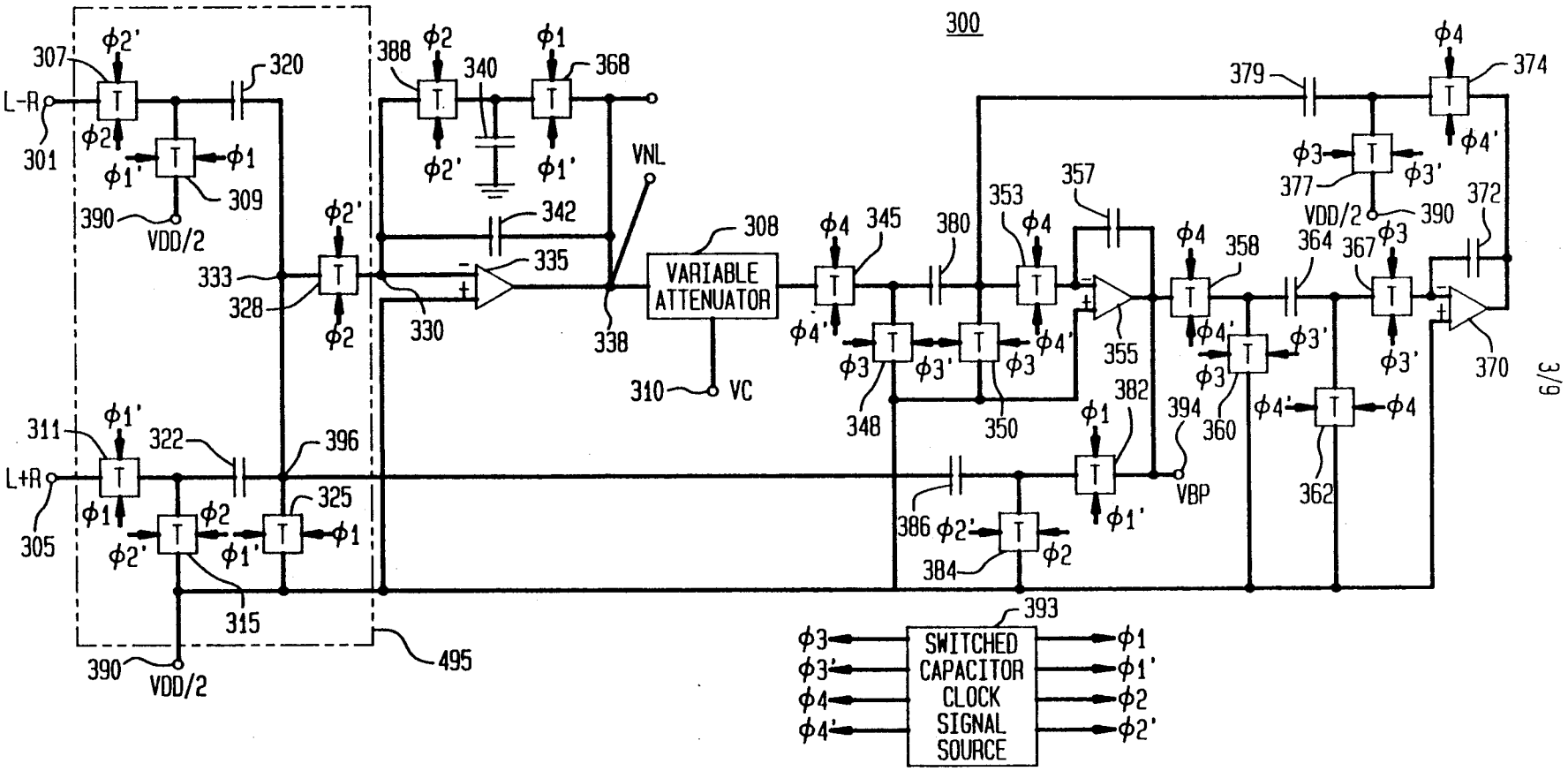
FIG. 3 is a schematic diagram of a LEFT channel notch filter employed in the audio processing circuit of FIG. 1.
Figure 4:
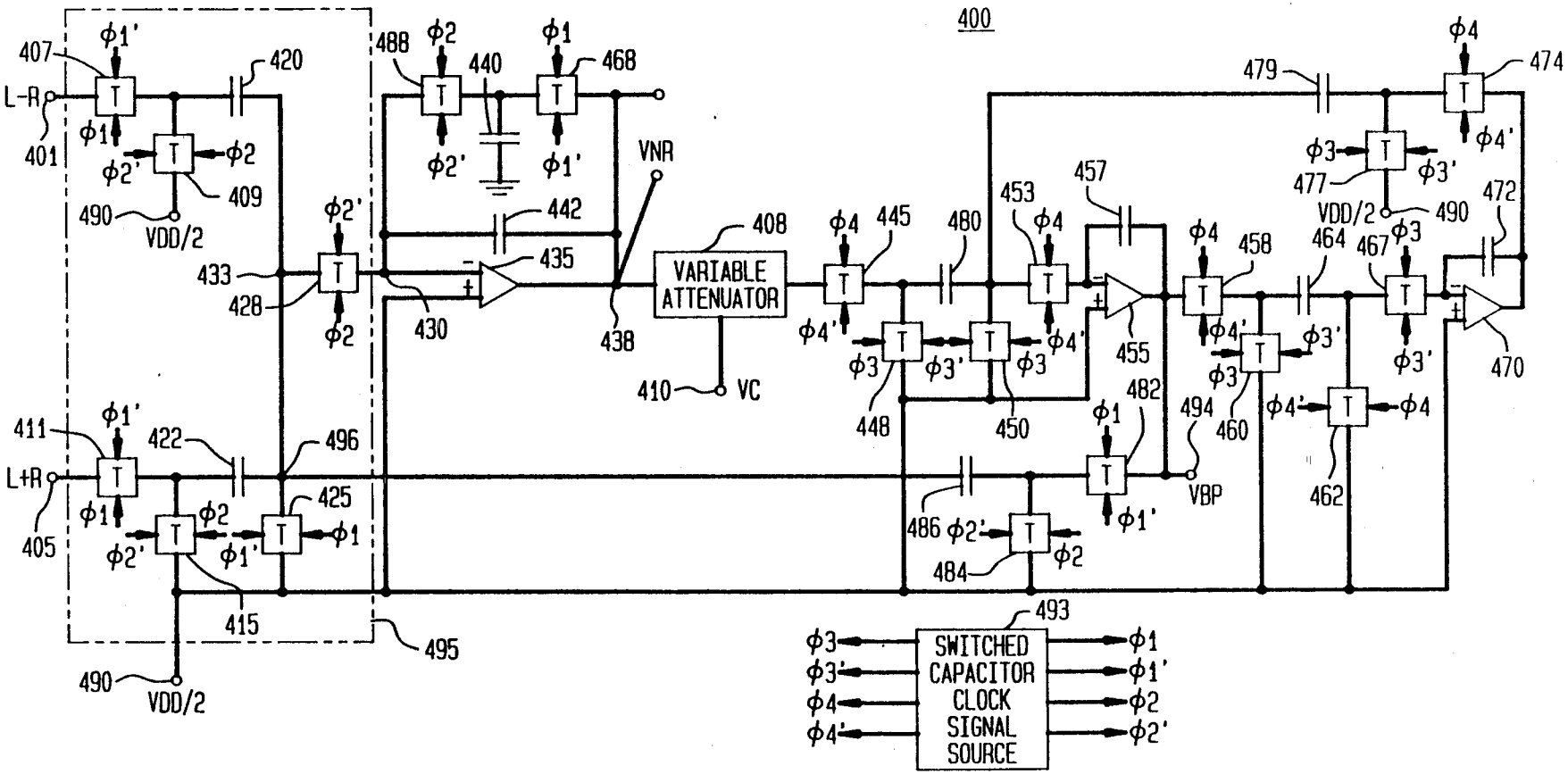
FIG. 4 is a schematic diagram of a RIGHT channel notch filter employed in the audio processing circuit of FIG. 1.

Matrix and variable Q 10 kHz notch filters 120 and 125 in the audio processing circuit 100 of FIG. 1 may each comprise continuously adjustable switched capacitor notch type filters 300 and 400 which are shown in FIGS. 3 and 4, respectively. Such a switched capacitor notch type filter is shown and described in the above denoted patent application entitled Switched Capacitor Filters With Continuous Time Control". Each of the notch type filters operates to combine signals (L+R) and (L−R) to form LEFT and RIGHT channel signals. The RIGHT channel signal is produced by the matrix and variable Q 10 kHz notch filter 120 and the LEFT channel signal is produced by the matrix and variable Q 10 kHz notch filter 125. Matrix and variable Q 10 kHz notch filters 120 and 125 further remove a relatively narrow band around 10 kHz of signals LEFT and RIGHT to reduce the adjacent channel interference under control of the correction signal from comparator circuit 103 in FIG. 1. The matrix and variable Q 10 kHz notch filter 125 additionally provides a 10 kHz bandpass signal VBF which is the inverse of the narrow band 10 kHZ signal removed from the LEFT channel signal to comparator circuit 103 of FIG. 1.

Referring now to FIG. 3, there is shown a schematic diagram of a switched capacitor filter 300 which is useful as the matrix and variable Q 10 kHz notch filter 125 in FIG. 1. The filter 300 is very similar to a filter of the above described patent application entitled "Switched Capacitor Filters With Continuous Control." The filter 300 comprises a pair of input terminals 301 and 305 for receiving the L−R signal and the L+R signal from the variable attenuator 115 and the variable lowpass filter 105, respectively, of FIG. 1; a supply terminal 390 having a DC voltage VDD/2 applied thereat; a switched capacitor matrix circuit 495 (shown within a dashed line rectangle) comprising transmission gates 307, 309, 311, 315, 325 and 328 and capacitors 320 and 322; a summing type operational amplifier circuit comprising an operational amplifier 335, transmission gates 368 and 388, a capacitor 340, and a feed back capacitor 342; an externally controlled variable attenuator 308; a first switched capacitor coupling network comprising transmission gates 345, 348, 350, and 353 and a capacitor 380; a first integrator comprising an operational amplifier 355 and a feed back capacitor 357; a second switched capacitor coupling network comprising transmission gates 358, 360, 362 and 367 and a capacitor 364; a second integrator comprising an operational amplifier 370 and a feedback capacitor 372; a switched capacitor feedback coupling network comprising transmission gates 374 and 377 and a capacitor 379; a second capacitor feedback network to the operational amplifier 335 comprising transmission gates 382 and 384 and a capacitor 386; and a switched capacitor clock signal source 393. The filter 300 receives signals L−R and L+R at terminals 301 and 305, respectively, and operates to form a LEFT channel signal minus a notch at 10 kHz that appears on an output terminal 338 (VNL) and also provides a 10 kHz bandpass signal VBF at terminal 394 that is the inverse of the 10 kHz notch to comparator circuit 103.

Switched capacitor clock signal source 393 generates at output terminals thereof clocks signals $\phi 1$, $\phi 1'$, $\phi 2$, $\phi 2'$, $\phi 3$, $\phi 3'$, $\phi 4$ and $\phi 4'$ which are distributed within the filter 300 to control gates of the various transmission gates. $\phi 1$ and $\phi 1'$ are complementary signals as are $\phi 2$ and $\phi 2'$, $\phi 3$ and $\phi 3$ and $\phi 4$ and $\phi 4$.' Source 393 can be formed from a variety of circuits known in the art.

In filter 300, clock signals $\phi 1$ and $\phi 2$ are used by transmission gates 307, 309, 311, 315, 325, 328, 368, 382, 388 and 384 in the matrix and summing amplifier sections of the filter 300. Clock signals $\phi 1$ and $\phi 2$ are non-overlapping square wave signals having a repetition rate of 45 kHz. Clock signals $\phi 3$ and $\phi 4$ are used by transmission gates 345, 348, 350, 353, 358, 360, 362, 367, 374 and 377 employed in the first integrator comprising operational amplifier 355 and the second integrator comprising operational amplifier 370. Clock signals $\phi 3$ and $\phi 4$ are at 225 kHz which is an integral multiple of the 45 kHz $\phi 1$ and $\phi 2$ clock signal frequency.

The signal L−R applied to the terminal 301 is transferred to a terminal 333 by the switched capacitor network including $\phi 1$ clocked transmission gates 309 and 325, $\phi 2$ clocked transmission gate 307 and the capacitor 320, while signal L+R is coupled to the terminal 333 through the switched capacitor network including $\phi 1$ clocked transmission gates 311 and 325, the $\phi 2$ clocked transmission gate 315 and the capacitor 322. The resulting signal at the terminal 333, i.e., the sum of signals L−R and L+R, corresponds to the LEFT channel signal. The terminal 333 also receives the inverse of the notch bandpass signal formed by the switched capacitor arrangement of capacitor 386 and $\phi 1$ clocked transmission gates 382 and 325 and $\phi 2$ clocked transmission gate 384. The LEFT channel minus the 10 kHz bandpass signals from terminal 333 is transferred to the negative input of operational amplifier 335 at the terminal 330 through $\phi 2$ clocked transmission gate 328. The combined LEFT channel and the inverse 10 kHz bandpass signal is further combined at the terminal 330 with the feedback signals from the switched capacitor circuit including $\phi 1$ clocked transmission gate 368, the $\phi 2$ clocked transmission gate 388 and the capacitor 340 and the feedback capacitor 342.

The signal VNL at an output terminal 338 of operational amplifier 335 is an amplified version of the LEFT channel signal minus the notch created by subtraction of the 10 kHz bandpass signal (9 kHz in the case of European receivers). The Q of the bandpass section of the filter 300 comprising the $\phi 1$ clocked transmission gates 382 and 325 and the $\phi 2$ clocked transmission gate 384, is controlled by the effective resistance of the switched capacitor coupling network between the output of the amplifier 335 and the input of the first integrator amplifier 355. The switched capacitor coupling network comprises the $\phi 3$ clocked transmission gates 348 and 350 and the $\phi 4$ clocked transmission gates 345 and 353 and the capacitor 380. As described with respect to switched capacitor lowpass filter 200 of FIG. 2, the effective resistance of this switched capacitor coupling network is controlled by adjusting the loss of attenuator 308 in accordance with the correction voltage appearing at the terminal 192 in FIG. 1.

The variable attenuator 308 can be any continuously adjustable voltage controlled attenuator as in the lowpass filter 200 of FIG. 2. In the preferred embodiment of our invention, however, the operational amplifier 335 and the variable attenuator 308 together comprise the dual output amplifier shown and described with respect to FIGS. 10 and 11. When the control voltage VC at the terminal 310 from terminal 192 of FIG. 1 is at its highest value, e.g., +4 volts, the Q of the band pass filter section of the switched capacitor filter 300 of FIG. 3 is at its maximum. If voltage VC decreases to 0.5 volts or less, the Q of the band pass section is reduced to its minimum value. The center frequency of the notch (e.g., 10 kHz) does not change over 0.5 to 4 volt range of control voltage VC.

The first integrator operational amplifier 355 receives one signal from switched capacitor 380 and another signal from switched capacitor 379 through the transmission gate 353 and is adapted by its feedback capacitor 357 to provide at a terminal 394 a bandpass voltage signal VBF. The signal VBF is coupled to the high Q 10 kHz bandpass filter 140 in FIG. 1 to form the filter correction signal VC. The effective resistance of switched capacitor 380 and associated transmission gates 345, 348, 350 and 353 determined by the voltage controlled attenuator 308 controls the bandwidth and shape of bandpass signal VBF. The second integrator operational amplifier 370 receives the bandpass signal VBF through the switched capacitor coupler comprising the capacitor 364 and transmission gates 358, 360, 362, and 367 and a signal through its feedback capacitor 372. The coupling and feedback arrangements between operational amplifiers 355 and 370 determine the center frequency of the switched capacitor notch filter 300 which remains invariant and the voltage controlled attenuator 308 permits variation of the Q of the filter characteristics. Operational amplifiers 355 and 370 may be replaced by variable attenuator arrangements such as employed in the variable attenuator 308 so that the parameters of the filter circuit 300 determined by the effective resistances of the switched capacitor arrangements including capacitor 364 or 379 may be varied in accordance with an external control voltage. The output VBF of the band pass section of matrix and variable Q 10 kHz notch filter 125 has a pass characteristic which is the complement of the rejection characteristic of the notch filter.

When filter 300 is used as matrix and variable Q notch filter 125 of FIG. 1, leads 301 and 305 of filter 300 are coupled to leads 108 and 118, respectively, of filter 125 of FIG. 1, and terminals 338 and 394 of filter 300 are coupled to leads 137 and 128, respectively, of filter 125 of FIG. 1.

Referring to FIG. 4, there is shown a schematic diagram of a switched capacitor filter 400 which is useful as the matrix and variable Q 10 kHz notch filter 120 in FIG. 1. The filter 400 is very similar to a filter of the above described copending patent application entitled "Switched Capacitor Filters With Continuous Time Control". The filter 400 comprises a pair of input terminals 401 and 405 for receiving an L−R signal and an L+R signal from the L−R signal and the L+R signal from the variable attenuator 115 and the variable lowpass filter 105, respectively, of FIG. 1; a supply terminal 490 having a DC voltage VDD/2 applied thereat; a switched capacitor matrix circuit including transmission gates 407, 409, 411, 415, 425 and 428 and capacitors 420 and 422; a summing type operational amplifier circuit including an operational amplifier 435, transmission gates 468 and 488, a switched capacitor 440, and a feedback capacitor 442; an externally controlled variable attenuator 408; a first switched capacitor coupling network including transmission gates 445, 448, 450, and 453 and a capacitor 480; a first integrator comprising an operational amplifier 455 and a feedback capacitor 457; a second switched capacitor coupling network including transmission gates 458, 460, 462 and 467 and a capacitor 464; a second integrator comprising an operational amplifier 470 and a feedback capacitor 472; a switched capacitor feedback coupling network including transmission gates 474 and 477 and a capacitor 479; a switched capacitor bandpass coupler including transmission gates 482 and 484 and a capacitor 486; and an output terminal 438. The filter 400 receives signals L−R and L+R at terminals 401 and 405, respectively, and operates to form a RIGHT channel signal minus a notch at 10 kHz that appears on the output terminal 438.

The operation of the switched capacitor filter embodiment 400 of matrix and variable Q 10 kHz notch filter 120 of FIG. 1 is substantially similar to that described with respect to the matrix and variable Q 10 kHz notch filter 300 of FIG. 3. Since the switched capacitor filter 400 is used as the matrix and variable Q 10 kHz notch filter 125 to produce the RIGHT channel signal, the $\phi 1$ clock signal is applied to the transmission gate 407 while the $\phi 2$ clock signal controls the operation of transmission gate 409. The sum of signals (L+R) and (L−R) is produced at terminal 433 so that the output of the circuit of FIG. 4 at the terminal 438 is the signal VNR corresponding to the RIGHT channel signal. Additionally, the filter 400 is not employed in the formation of the correction signal VC and therefore no 10 kHz bandpass signal is output from the switched capacitor filter 400.

When filter 400 is used as matrix and variable Q notch filter 120 of FIG. 1, leads 401 and 405 of filter 400 are coupled to leads 108 and 118, respectively, of filter 125 of FIG. 1, and terminal 438 of filter 300 is coupled lead 136 of filter 125 of FIG. 1.

Figure 6:
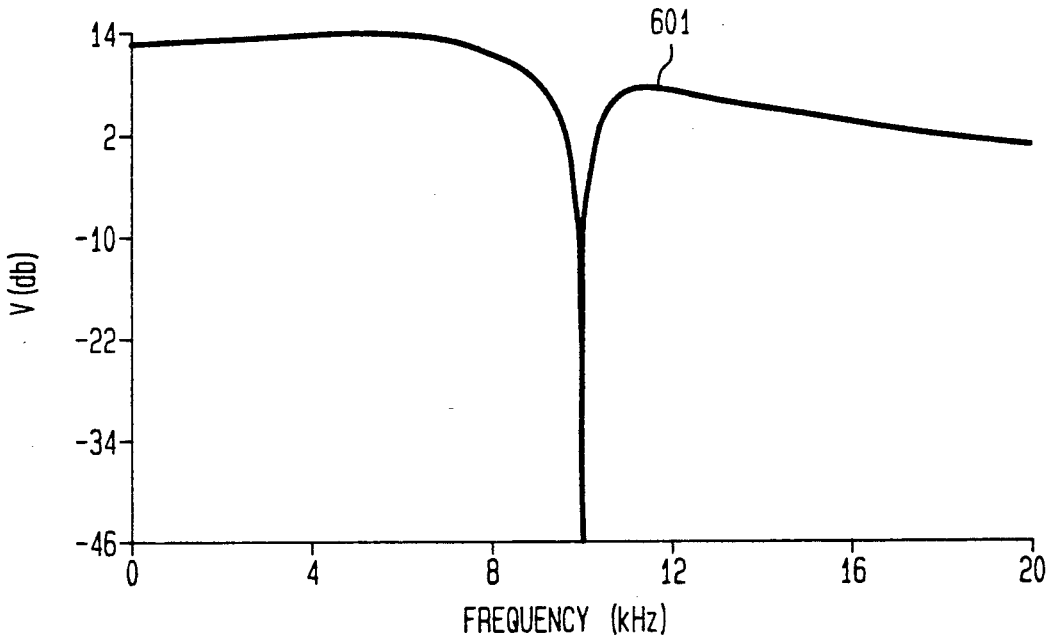
FIG. 6 is a plot illustrative of the composite response of the lowpass and notch filters connected in the RIGHT channel of FIG. 1 in the absence of adjacent channel noise.
Figure 7:
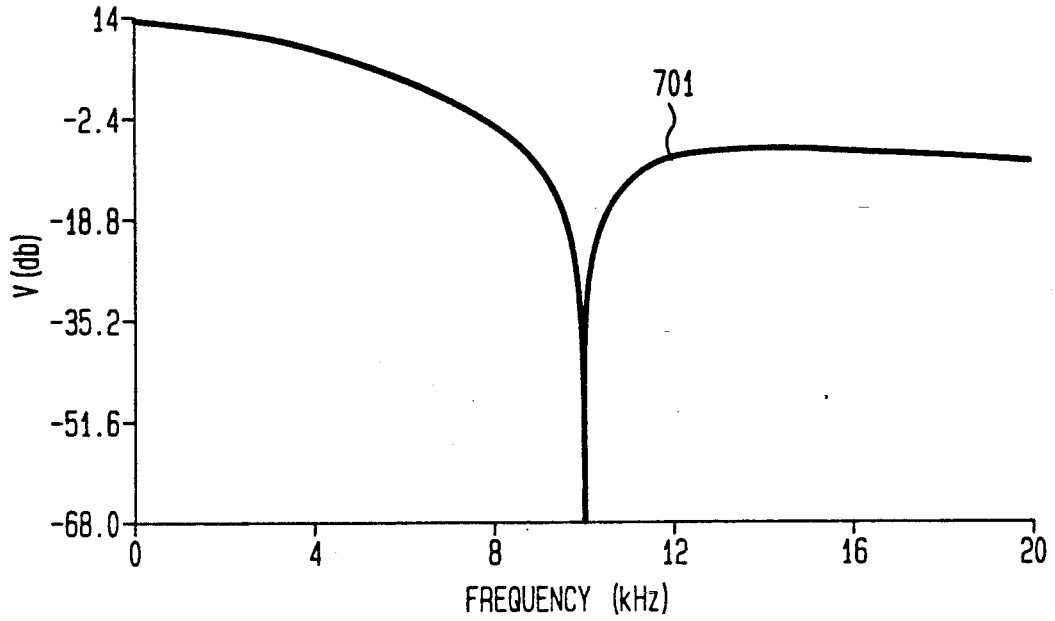
FIG. 7 is a plot illustrative of the composite response of the lowpass and notch filters as connected in the RIGHT channel of FIG. 1 in the presence of strong adjacent channel noise.

FIG. 6 shows a voltage vs. frequency waveform 601 that is illustrative of the composite response of the variable lowpass filter 105 and the matrix and variable Q 10 Khz notch filter 120 associated with the RIGHT channel of FIG. 1 in the absence of adjacent channel interference. When there is minimum adjacent channel noise, a relatively high correction voltage VC appears at the terminal 192. This relatively high VC voltage is supplied to the variable lowpass filter 105 and to the matrix and variable Q 10 kHz notch filter 120. The pass band and Q of the signal path including the variable lowpass filter 105 and the matrix and variable Q 10 kHz notch filter 120 are maximum. FIG. 7 shows a voltage vs. frequency waveform 701 illustrative of the composite response of the variable lowpass filter 105 and the matrix and variable Q 10 kHz notch filter 120 in the presence of strong adjacent channel noise. As a result of the adjacent channel noise, the correction voltage VC is 0.5 volts or less. The notch in the waveform 701 is much wider than the notch in waveform 601 and the RIGHT channel hi frequency signals in waveform 701 are more attenuated than the RIGHT channel hi frequency signals in waveform 601 of FIG. 6. The center frequency in waveform 701 at which the notch voltage is a minimum is the substantially unchanged from that shown in FIG. 6.

It is to be understood that the specific embodiments described herein are intended merely to be illustrative of the spirit and scope of the invention. Modifications can readily be made by those skilled in the art consistent with the principles of this invention. For example, a plurality of lowpass filters may be cascaded in the L+R and L−R signal paths to further control the corner frequency characteristics in response to the adjacent channel interference. Still further, an attenuator may be inserted in the L+R path to control the relative levels of the LEFT and RIGHT channels in accordance with the adjacent channel interference. Furthermore, the filter control signal may be made responsive to combinations of the L+R and L−R signals other than the combination in the LEFT channel matrix and variable Q 10 kHz notch filter.

The embodiments of the invention in which an exclusive property or privilege is claimed are defined as follows:

1. A signal processing system comprising:

means for receiving signals in a prescribed frequency band including a first signal and interference from frequencies adjacent the prescribed frequency band;

means responsive to the received signals for adjustably limiting the prescribed frequency band of the received signals to produce a output signal representative of the first signal;

means responsive to the interference from frequencies adjacent to the prescribed frequency band for producing a band adjustment signal;

means responsive to the band adjustment signal for adjusting the prescribed frequency band to reduce the interference in the output signal;

said means for producing the band adjustment signal comprising means responsive to the interference from the frequencies adjacent to the prescribed frequency band for forming an interference representative signal, means for generating a predetermined threshold signal, means for detecting the difference between the interference representative signal and the predetermined threshold, and means responsive to the detected difference for producing the band adjustment signal;

said means for forming the interference representative signal comprising means for forming a narrow frequency band signal centered at the edge of the prescribed frequency band;

said predetermined threshold signal generating means comprising means for producing a prescribed voltage;

said difference detecting means comprising means for producing a difference detecting means comprising means for producing a difference representative signal having a first value when the interference representative signal exceeds the prescribed voltage and a second value when the interference representative signal is less than or equal to the prescribed voltage;

said difference detecting means further comprising means responsive to the difference representative signal for forming a continuously varying band adjustment signal;

said narrow band difference signal being a narrow band sine wave like signal representative of the interference from the frequencies adjacent to the prescribed frequency band; and said difference detecting means further comprising means for comparing the narrow band sine wave like signal to the prescribed threshold voltage to produce a pulse having a prescribed voltage when the narrow band sine wave like signal exceeds the prescribed threshold voltage.

2. In a receiver having a decoder providing an audio signal output from a transmission channel, a closed loop audio processing system including a variable Q notch filter, a variable lowpass filter connected in an audio signal path between said decoder and said notch filter, control means responsive to the output of said notch filter for developing a control signal and applying said control signal to said lowpass filter and said notch filter for controlling the bandwidth of the lowpass filter and the Q of the notch filter to thereby reduce adjacent channel interference.

3. The receiver of claim 2 wherein the decoder is an AM stereo decoder, the audio signal output is the L−R output of the decoder, and the notch filter rejects signals at 10 kHZ.

4. A stereophonic AM radio audio processing system for forming LEFT and RIGHT channel audio signals from a stereophonic AM channel comprising:

means for receiving an L+R audio signal from the stereophonic AM channel;

means for receiving an L−R audio signal from the stereophonic AM channel;

first filtering means comprising:

an input for receiving the L+R audio signal;

means having an adjustable corner frequency and an adjustable Q for lowpass filtering the L+R audio signal from the first filtering means input; and an output;

second filtering means comprising:

an input for receiving the L−R audio signal;

means having an adjustable corner frequency and an adjustable Q for lowpass filtering the L−R audio signal from the second filtering means input; and an output, third filtering means comprising:

an input coupled to the output of the first filtering means for receiving the lowpass filtered L+R and L−R audio signals from the first and second filtering means;

matrix means for forming a RIGHT channel signal from the lowpass filtered L+R and L−R signals;

filter means having a notch filter centered at the band edge of the RIGHT channel signal with an adjustable Q for reducing the adjacent channel interference at the band edge of the RIGHT channel signal;

fourth filtering means comprising:

an input coupled to the output of the first and second filtering means for receiving the lowpass filtered L+R and L−R audio signals from the first and second filtering means;

matrix means for forming a LEFT channel signal from the lowpass filtered L+R and L−R signals;

filter means having a notch filter centered at the band edge of the LEFT channel signal with an adjustable Q for reducing the adjacent channel interference at the band edge of the LEFT channel signal; and means for forming a bandpass signal centered at the band edge of the LEFT channel signal representative of the adjacent channel interference; and means responsive to the adjacent channel interference band pass signal from the fourth filtering means for producing a filter correction signal, and said first, second, third and fourth filtering means each further comprising means responsive to the filter correction signal for varying the adjustable corner frequency and adjustable Q of the filtering means to minimize the adjacent channel interference in the audio signal applied thereto.

5. The AM stereophonic AM radio audio processing system of claim 4 further comprising:

means connected between the output of the second lowpass filtering means and the fourth notch filtering means responsive to the filter correction signal for adjustably attenuating the lowpass filtered L−R signal from the second filter means.

6. An AM radio audio processing system comprising:

means for receiving one or more audio signals from an AM channel; and means connected to the receiving means having an adjustable Q notch and an adjustable corner frequency lowpass for filtering the one or more audio signals from the receiving means comprising:

means for producing a bandwidth limited output audio signal; and means for producing a signal corresponding to adjacent channel interference in the one or more audio signals from the receiving means; and means responsive to the adjacent channel interference signal from the filtering means for producing a filter correction signal; and means responsive to the filter correction signal for varying the adjustable Q notch and adjustable corner frequency lowpass to minimize the adjacent channel interference in the audio signal.

7. The AM radio audio processing system of claim 6 wherein the means for producing a filter correction signal comprises:

means responsive to the adjacent channel interference signal from the filtering means for forming a narrow band signal representative of the adjacent channel interference;

means for generating a predetermined threshold signal;

means for detecting the difference between the narrow band signal representative of adjacent channel interference and the predetermined threshold, and means responsive to the detected difference for producing the filter correction signal.

8. The AM radio audio processing system of claim 7 wherein:

the means for forming a narrow band signal representative of the adjacent channel interference comprises means responsive to the adjacent channel interference signal from the filtering means for forming a narrow band signal centered at the edge of the channel of the received audio signal;

the predetermined threshold signal generating means comprises means for producing a prescribed voltage; and the difference detecting means comprises means for producing a difference representative signal having a first value when the narrow band signal representative of adjacent channel interference exceeds the predetermined prescribed voltage and a second value when the narrow band signal representative of adjacent channel interference is less than or equal to the predetermined prescribed voltage.

9. The AM radio audio processing system of claim 8 wherein the difference detecting means further comprises means responsive to the difference representative signal for forming a continuously varying filter correction signal.

10. The AM radio audio processing system of claim 9 wherein:

the narrow band difference signal is a narrow band sine wave like signal representative of the adjacent channel interference; and the difference detecting means comprises means for comparing the narrow band sine wave like signal to the prescribed threshold voltage to produce a pulse having a prescribed voltage when the narrow band sine wave like signal exceeds the prescribed threshold voltage.

11. The AM radio audio processing system of claim 9 further comprising:

means for generating a signal representative of reception conditions; and wherein the means for forming the filter correction signal further comprises means responsive to reception condition signals for modifying the continuously varying filter correction signal.

12. The AM radio audio processing system of claim 10 wherein the means for forming the continuously varying filter correction signal comprises:

an input terminal for receiving the pulses from the difference detecting means;

an output terminal;

a voltage source;

a capacitor having one terminal connected to ground potential and the other terminal connected to said output terminal;

a capacitor charging resistor having one terminal connected to the voltage source and the other terminal connected to the output terminal;

a capacitor discharging resistor having one terminal connected to the output terminal; and a transistor switch having a control terminal connected to said input terminal for receiving the pulses from the difference detecting means and first and second switch terminals connected respectively to ground potential and to the other terminal of the capacitor discharging resistor.

13. The AM radio audio processing system of claim 6 wherein:

the filtering means comprises:

first filtering means comprising:

an input for receiving the one or more audio signals from the receiving means;

means having an adjustable corner frequency for lowpass filtering the one or more audio signals from the input; and an output, and second filtering means comprising:

an input coupled to the output of the first filtering means for receiving the lowpass filtered signal from the first filtering means;

filter means having a notch centered at the edge of the channel of the received audio signal with an adjustable Q for reducing the adjacent channel interference at the edge of the channel of the lowpass filtered signal from the first filtering means responsive to the correction voltage;

means for forming a bandpass signal at the edge of the channel of the lowpass filtered signal from the first filtering means; and means for applying the bandpass signal at the edge of the channel of the lowpass filtered signal to the means for producing a filter correction signal.

14. The AM radio audio processing system of claim 13 further comprising:

means connected between the first filtering means and the second filtering means responsive to the filter correction signal for attenuating the lowpass filtered signal from the first filtering means.

* * * * *